United States Patent [19]

Whiteley

[11] Patent Number: 4,647,041

[45] Date of Patent: Mar. 3, 1987

[54] EXERCISE APPARATUS

[76] Inventor: Neville C. Whiteley, 8 Brecon Street, Lockleys 5032, Adelaide, Australia

[21] Appl. No.: 698,101

[22] Filed: Feb. 4, 1985

[51] Int. Cl.[4] ..... A63B 23/04

[52] U.S. Cl. ..... 272/132; 272/134; 272/130

[58] Field of Search ..... 272/134, 132, 131, 130, 272/129, 125, DIG. 4

[56] References Cited

U.S. PATENT DOCUMENTS

| | | | |
|---|---|---|---|
| 2,722,419 | 11/1955 | Tarapczynski | 272/123 |
| 3,103,357 | 9/1963 | Berne | 272/134 X |
| 3,384,370 | 5/1968 | Bailey et al. | 272/123 |
| 3,465,592 | 9/1969 | Perrine | 272/130 |
| 3,953,025 | 4/1976 | Mazman | 272/132 |
| 4,235,437 | 11/1980 | Ruis et al. | 272/134 |
| 4,349,192 | 9/1982 | Lambert, Jr. et al. | 272/118 |
| 4,411,424 | 10/1983 | Barnett | 272/118 |
| 4,436,303 | 3/1984 | McKillip et al. | 272/132 |
| 4,465,274 | 8/1984 | Davenport | 272/130 |
| 4,492,375 | 1/1985 | Connelly | 272/134 |

FOREIGN PATENT DOCUMENTS

| | | | |
|---|---|---|---|
| 40866/72 | 10/1973 | Australia | 272/134 |

*Primary Examiner*—Richard J. Apley
*Assistant Examiner*—John L. Welsh
*Attorney, Agent, or Firm*—Albert O. Cota

[57] ABSTRACT

An exercise apparatus with a pedestal (24) abutted onto a base (20) on one end and a recess (22) near the other. A biforcated arm (30) is rotatably attached to a main shaft (28) in the pedestal (24). The arm (30) contains angular grips (32) and a removable bar (36) near the extended end. Resistance is afforded by a hydraulic system comprising a manual actuated cylinder (44) connected to a caliper brake (42) gripping the sides of a geared disk (40). Adjustable control of the holding force is provided by mechanical linkage rotatably connected to a hand wheel (52) located on top of the arm applying pressure to the cylinder (44). The direction of resistance either up or down in the stroke of the arm is governed by another linkage utilizing a pawl (68) having teeth intermeshing with the teeth of the geared disk (40).

11 Claims, 12 Drawing Figures

EXERCISE APPARATUS

TECHNICAL FIELD

The invention relates to exercise devices or equipment having resistance against a fixed surface, in general and more specifically to an apparatus having a base with extended movable arms providing adjustable constant resistance throughout the arm movement.

BACKGROUND ART

Existance of mechanical devices for exercising the human body are well known. In most cases the exercise device is attached to the floor, or some other structural member, in order to provide stability or a mechanical advantage in lever form. This attachment to the floor is most widely used in exercising the large muscles, such as arms, legs, back, etc.

A search of the prior art did not disclose any patents that directly read on the claims of the instant invention. However, the following U.S. Patents are considered to be relevant.

| U.S. Pat. No. | Inventor | Issued |
|---|---|---|
| 4,319,747 | Rogers | Mar. 16, 1982 |
| 4,023,796 | Kusmer | May 17, 1977 |
| 3,567,219 | Foster | Mar. 2, 1971 |
| 2,356,260 | Maxwell | Aug. 2, 1944 |
| 2,261,173 | Maxwell | Nov. 4, 1941 |

A portable device is taught by Kusmer which employs the principle of isotonic in conjunction with isometric exercise. This apparatus utilizes compression springs and a lever stopping member to control over travel when the levers pass dead center reaching their maximum value.

Other prior art utilizing rigid floor mounted structure include a U.S. Patent issued to Rogers, in which weights are suspended and a cam arrangement is utilized lifting the dead weight creating the resistance for arm exercise. Also, multi-purpose body exercising apparatus is included, using a bench for the base to which other structure is added for different resistive events.

Maxwell in U.S. Pat. No. 2,261,173 teaches a set of spring loaded swingable bars grasped by the hands of a user, which is in turn, mounted on a wall or other rigid structure. Adjustment in compression is made by changing the arcuate position of a tension spring, and a slideable body on a pair of rods allow vertical adjustment.

A pair of radially extended allochirally-related flexible arms are disclosed by Foster. The arms are adjustably positioned on a transversely-extended plate secured to a horizontal base located on the floor. These flexible arms are made of steel and extend parallel to the surface of the base having a series of holes. The hole attachment provides the relation of the length of extension creating the adjustment for resistance offered to a person employing the device.

Finally, Maxwell, in a later issued U.S. Pat. No. 2,356,260, takes advantage of a pair of parallel bars, spring loaded at the axis, that are attached to a mounting plate adapted to be applied to a wall or other vertical support in a removable manner. Rotation of the bars in the mounting plate allow different forms of linear thrust to be accomplished by the user to develop chest, back, neck, and shoulder muscles.

It will be noted that prior art includes springs in tension, mostly utilizing a stationary base, or mounting surface, and combinations of gears and cams to accomplish the resistive utility.

DISCLOSURE OF THE INVENTION

As more medical knowledge has been gained and people have become more aware of the benefits of physical exercise, emphasis has become centered on the need to exercise ones muscles on a regular basis. Further, in the case of rehabilitation, physical exercise under controlled conditions has become almost mandatory. The need for exercise has also become increasingly meaningful with the handicapped and aged. As previously discussed, prior art has developed either equipment for a large permanent nature for gymnasiums and body building establishments, or small portable devices that are used within the home. It is, therefore, a primary object of the invention to provide an exercise apparatus which is multi-purpose being capable of carrying out a number of different exercise routines for both the abled and the handicapped, while combining both aerobic and isotonic movements. Further, the invention is small enough to be transported from place to place, and yet durable enough to be included in a constant use gymnasium.

An important object of the invention further allows a high degree of safety to be realized for both the able and handicapped. In most cases prior art requires the movement of the separated elements to return to their at rest condition during operation, as an example, when bars or handles are lifted in exercises, such as presses, lifts, squats, curls, bends, etc., the resistance is provided by dead weights or springs, which by their very nature must return to the unloaded position. If by chance the person using the equipment is unable to continue the procedure, sufficient strength is required to relieve the resistance, whereas the instant invention exacts no such demands. This safety feature alone allows handicapped persons to freely utilize the apparatus, as the separated elements may be stopped at any point in their travel and remain stationary. It may be seen that with any operating person, the need for attendants is completely eliminated. The moving parts of the invention are also safely covered and protected, also, some embodiments may include resistance readouts in braille for the blind.

Another object and advantage of the present invention is to provide an exercise apparatus which is simple, non-bulky, light weight, and contains few parts, yielding a long life expectancy even when used commercially. Inasmuch as the device is light in weight and compact, it is easily moved or transported and its simplicity allows the cost impact to be minimized.

Still another object is directed to the ease of operation, as only two manual controls are required. First, the load is varied by simply rotating a hand wheel located on the top of the main arm in the direction desired to either increase or decrease the resistance. A gauge is provided between the forks of the arm that indicates the load setting. Second, a lever is positioned nearby that determines the direction of force controlled by linear movement fore and aft. The arm automatically is moved freely in the unloaded direction with an audiable clicking sound, as the spring loaded linkage separates the teeth of the gears. By contrast prior art, in the large gravity assisted exercise apparatus, requires addition or removal of individual weight bars, usually located at the back side of the machine requiring the operator to walk around to make the adjustment.

Yet another object of the invention is the constant load or resistance of the arms throughout the entire arc of movement. As the load does not require weights connected by cables or chains and eccentric cams, the frictional resistance of the position of the arm becomes irrelevant. Even the weight of the arm itself is counterbalanced, therefore, infinite settings may be made on the resistance that remain the same regardless of arm position. If weights were used, such as in prior art, resistance is limited to the particular increment allowed by the weight itself, whereas the instant invention is not so limited.

A further object lies in the adaptability of the device to receive accessories to further the utility of the system. A treadmill having a platform configured in wave pattern, creating a heel and toe strike guide, is easily adapted into a well of the platform with the arms becoming the safety handles. It will be noted that this type of platform is directed toward the handicapped, such as the blind, as the position of the feet may be felt by the inclined ends. Further, incline and decline exercises may be accomplished with the use of a wedge shaped tilted platform also fit into the well in a position directly beneath the arms. A workbench is also securely positioned within the well having the front leg the proper width, allowing containment with longitudinal adjustment. This accessory permits a myriad of exercises to be accomplished with lifts, curls, presses, etc., while sitting or laying flat. The combination of accessories and adaptability of linear force allow many and varied exercises to be accomplished by the able, while the safety provisions and ability to accommodate wheelchairs and other accessories provide maximum utility for the handicapped.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in the terms of a preferred embodiment which includes a number of ancillary elements that attach singly within the apparatus and are used, in most cases, one at a time. The primary function of the device deals with exercising the human body with mechanical equipment.

Figure 1:
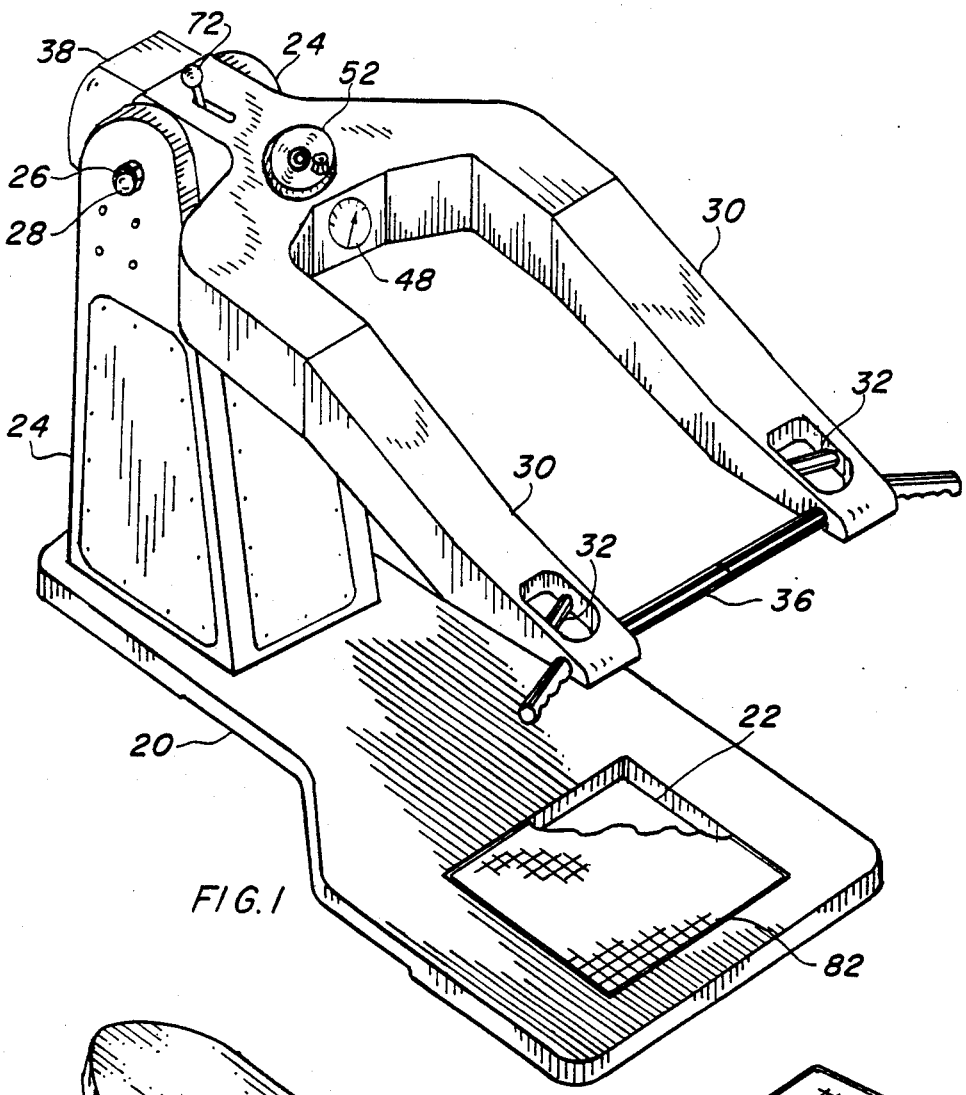
FIG. 1 is a partial isometric view of the preferred embodiment with the resilient mat in place, shown partially cut-away for clarity and the removable center jointed bar installed.

The preferred embodiment, as shown isometrically in FIG. 1, is comprised of a platform base 20 having a flat surface on the top with downwardly flanged peripheral edges and a flat surface underneath for resting upon a floor. A recessed well 22 is located within the base 20 on the top surface near one end and is rectangular in shape. The well 22 is the approximate depth of the flanges and the bottom rests upon the floor planar to the top surface. Auxillary components may be held captivated within this well 22, providing a mounting receptacle within the base.

A pedestal 24 is attached to the base 20 at the end opposite the well 22 and extends vertically. The bottom of the pedestal 24 is larger than the top, tapering on the edge closest to the well 22 with preferably a radiused shape at the top. Near the extended end a pair of opposed retaining bores 26 penetrate through each side with a main round shaft 28 rotatably captivated within. These bores 26 provide a movable mounting member at right angles to the pedestal 24 positioning the shaft 28 horizontally.

Figure 6:
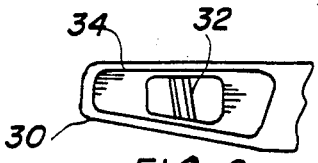
FIG. 6 is a partial view of one of the arms taken along lines 6—6 of FIG. 5.
Figure 7:
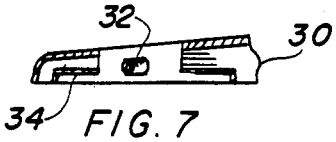
FIG. 7 is a cross-sectional view taken along lines 7—7 of FIG. 5.

A biforcated arm 30 is movably attached to the main shaft 28 extending over the base 20. The arm 30 is flat on the top pitching downwardly at the extreme end opposite the pivot point attached to the shaft 28. At the extended end of each fork of the arm 30 contains a pair of angular grips 32 that are embedded into the structure, shown pictorially in FIGS. 1, 6 and 7. The grip angle is located in such a manner as to be easily grasped by a person standing on the platform base 20 rotating the forked arm 30 away from the body. In the same proximity, but underneath, a pair of foot pads 34 are disposed under each grip 32, allowing a flat surface to place ones foot when pushing the arm 30 axially upward. These pads 34 are best illustrated in FIGS. 6 and 7, viewed underneath and cross-sectionally. The arm 30 may be constructed of any material having suitable structural integrity for the application, such as steel, aluminum in sheet form, welded together, or a structural thermoplastic having high impact strength and characteristics adapted for moldability. Any plastic molding technique may be utilized, such as injection molding, or vacuum, or cold forming, or a combination thereof.

Figure 4:
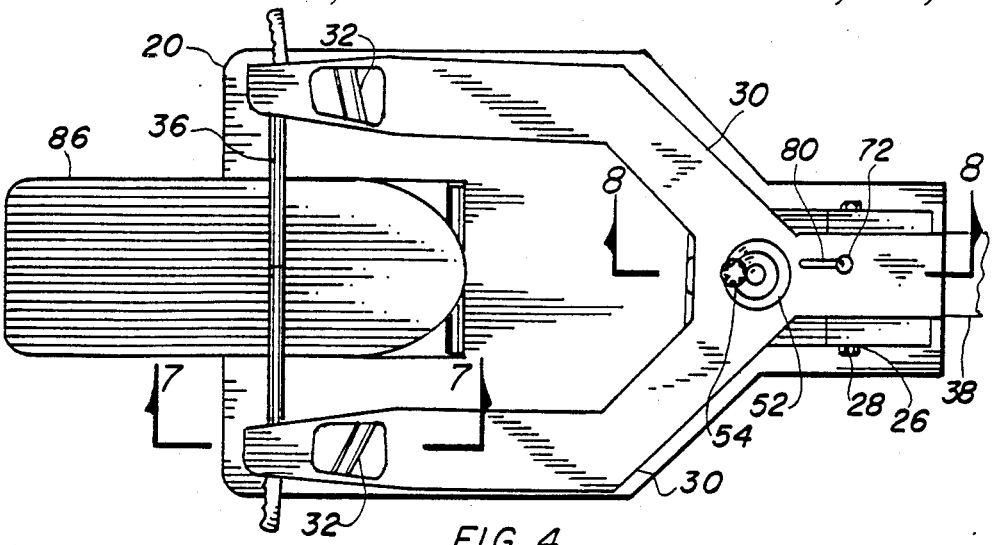
FIG. 4 is a plan view of the preferred embodiment with the bar and bench in place.
Figure 5:
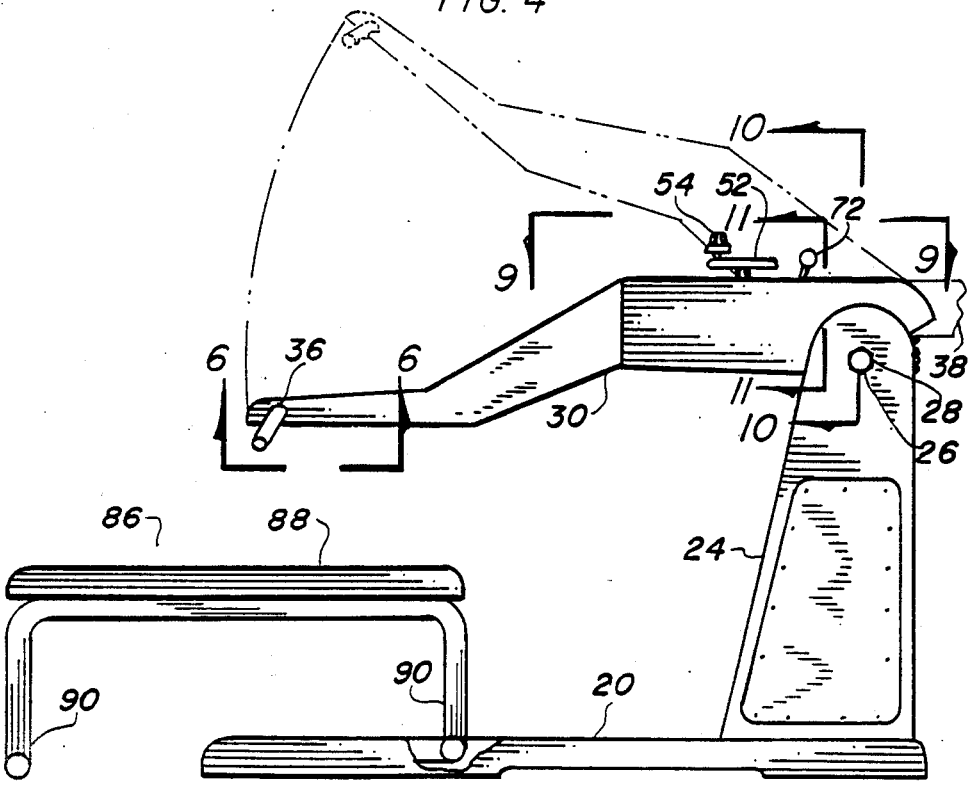
FIG. 5 is a side elevation view of the preferred embodiment with the bar and bench in place with the arm shown in phantom in its partially raised position.

An auxillary component to the arm 30 is a removable center jointed bar 36, best illustrated in FIGS. 1 and 4, that is positioned therethrough near the extended end. The bar 36 is separable in the center and contains angular ends, each covered with a resilient grip. The bar 36 penetrates each end of the arm 30 in a horizontal plane and is joined in the middle forming a connecting member between the forks of the arm 30 with angular extended ends on each side. This arrangement allows gripping from each outside surface or with the hands together along the bar 36 on the inside during different exercise routines.

In order to create a balanced condition of the arm 30, a counterweight 38 is located opposite the forked extensions. This counterweight is attached to the arm and may be any substance having a high specific gravity, such as metal. As the arm is light in weight and the couterbalance heavy, the rear extension from the main shaft 28 is minimal.

The function of the apparatus is to provide resistance when rotating the arm 30 such as would be found if a weighted body were to be lifted up manually. This resistance is required to be adjustable to fit the particular type of exercise and the person using the apparatus, therefore, means to accomplish this function are contained within the arm 30 and pedestal 24.

A geared disk 40 is rotatably positioned upon the main shaft 28 and contains flat parallel surfaces on the sides with teeth on the periphery. This disk 40 freely revolves on the main shaft 28 and is reinforced in the center with a raised hub on each side.

While the disk 40 is free to rotate, this movement is controlled by a caliper brake 42 with a pad on each side exerting force in a squeezing manner. This force creates friction, and as the brake 42 is rigidly attached to the pedestal 24, the resistance in the form of friction is transmitted directly to the disk 40 as it rotates therebetween. The brake 42 is hydraulically actuated by fluid pressure working upon opposed internal cylinders.

The hydraulic pressure is supplied by a cylinder 44 that is also disposed within the arm 30. This cylinder 44 is connected with hydraulic lines 46 to the brake 42 in a closed system as the cylinder 44 itself contains its own reservoir much like that of a conventional automotive master cylinder. To complete the hydraulic system, a pressure gauge 48 is included, as shown in FIG. 1, installed at a convenient location between the forks of the arm 30. This gauge 48 is preferably of the bourden tube type causing an indicating needle to rotate in response to the pressure within a coiled tube loaded in such a manner as to be physically uncoiled when pressure is applied. The gauge 48 is calibrated to read directly the weight force required to move the arm 30 at its manual handle interface. It will be noted that this element is not essential to the function of the invention and, therefore, may be omitted or another type of device substituted with no effect upon the units operation.

Figure 8:
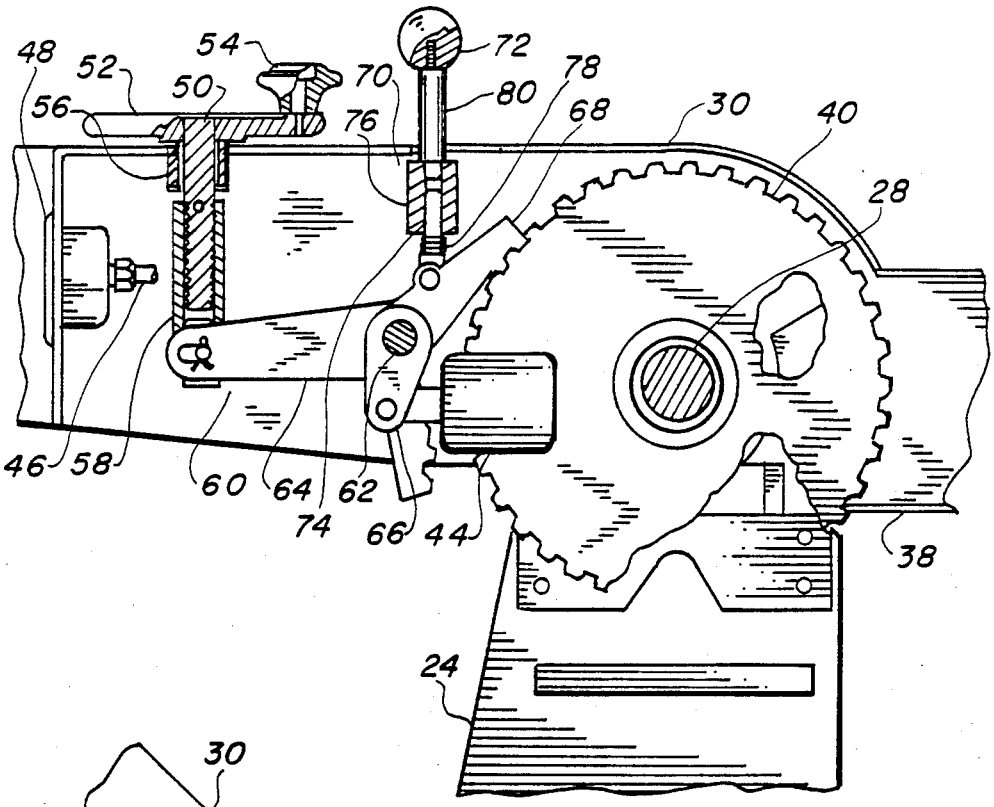
FIG. 8 is a fragmentary cross-sectional view taken along lines 8—8 of FIG. 4.
Figure 9:
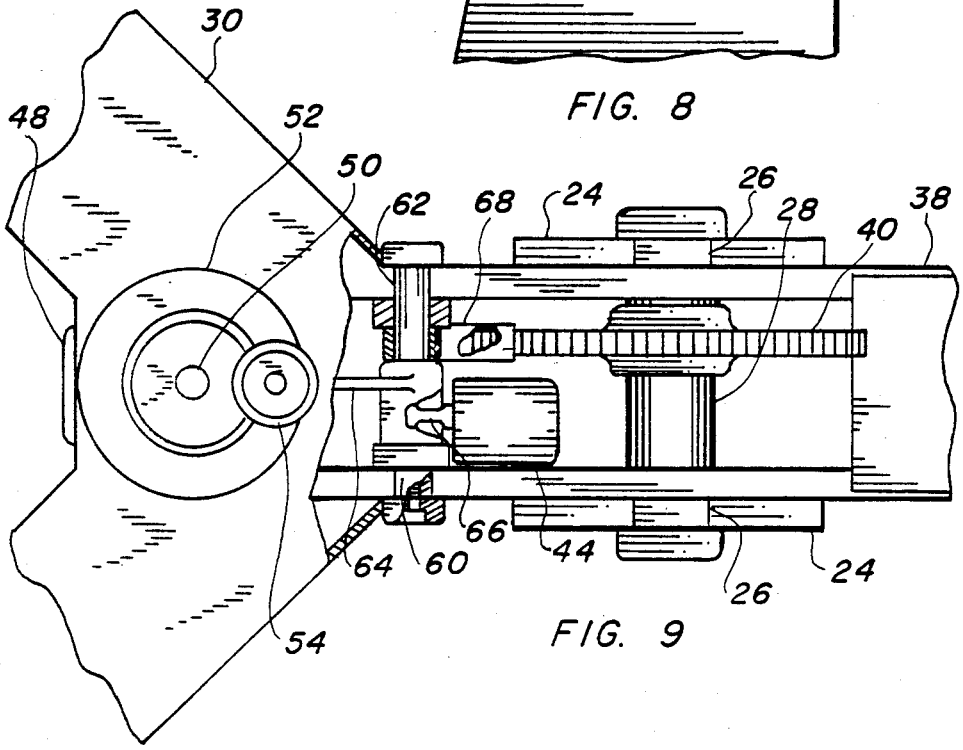
FIG. 9 is a fragmentary cross-sectional view taken along lines 9—9 of FIG. 5.
Figure 10:
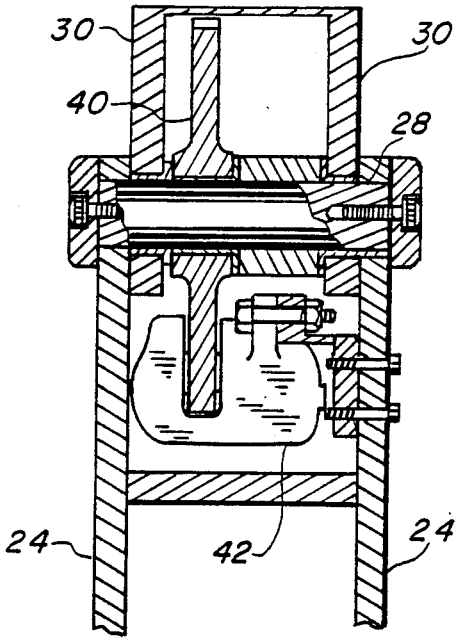
FIG. 10 is a partial cross-sectional view of the interface joint of the apparatus taken along lines 10—10 of FIG. 5.

In order to mechanically govern the hydraulic pressure, a resistance regulating mechanism is utilized that may be manually preset by the user. This mechanism, best illustrated in FIGS. 8 and 9, is also housed basically within the arm 30 and consists of a male threaded shaft 50 having a hand wheel 52 rotatably attached on one end. The hand wheel 52 may contain a swivel knob 54 for ease of manual operation, but again, is not necessary for the function. The shaft 50 is threaded on the extended end only with the straight end next to the hand wheel 52 contained within a bearing collar 56 that is permanently attached to the inside of the arm 30.

An internally threaded sleeve 58 intimately embraces the threaded shaft 50 causing the shaft to physically move vertically in linear fashion as the hand wheel 52 is rotated. A fork is included into the bottom portion of this sleeve 58 and is slideably attached to a pivotal link 60 takes advantage of the vertical linear movement of the shaft 50 transmitting this force directly to the cylinder 44. The link 60 has a rod 62 that penetrates each side of the arm 30 in a pivotal manner and has a first extended lever arm 64 connecting the rod 62 to the threaded sleeve 58 in a horizontal direction. A second pivotal arm 66 is vertically linked directly to the cylinder 44. When the hand wheel 52 is rotated, compounded pressure within the cylinder 44 is transmitted through the hydraulic lines 46 directly to the caliper brake 42 causing the opposed pads to grip the disk 40 controlling the friction as desired by the user. It will be noted that the preferred length of the arms 64 and 66 are in a ratio of 3 to 1, creating a mechanical advantage on the system. The first arm 64 is the longest allowing three times the movement of the threaded shaft 50 to finally actuate the cylinder 44.

Figure 11:
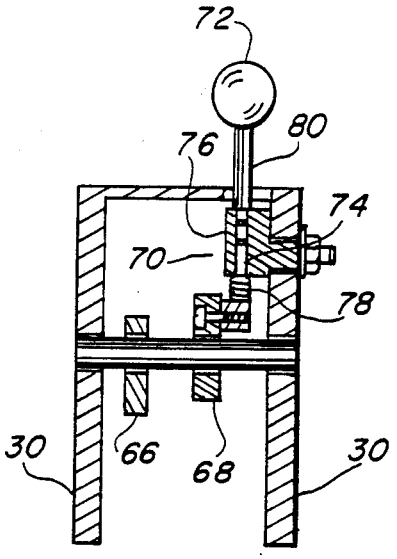
FIG. 11 is a cross-sectional view taken along lines 11—11 of FIG. 5.
Figure 12:
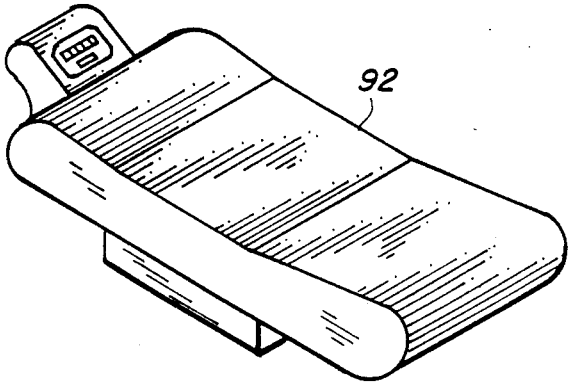
FIG. 12 is a partial isometric view of the treadmill completely removed from the exercise apparatus.

Directional linkage to control the resistance in either a lifting up or pulling down mode of the biforcated arm 30, shown best in FIGS. 8 and 9, consists of a unidirectional pawl 68 that is rotatably connected to the rod 62 of the pivotal link 60 in direct alignment with the geared disk 40. This pawl 68 is in a "C" shape slightly wider than the disk 40 with a set of teeth on each end facing the disk 40. The pivot point is centrally located allowing the pawl 68 to rotate and engage the teeth of the disk 40 on either one end or the other in a meshing fashion. When the teeth are meshed together on one of the ends, the entire arm 30 is now in communication with the pedestal 24 and base 20 through the pressure resistance pads of the caliper brake 42. This linkage then allows the force to be transmitted to the arm 30 in one direction or the other as desired. This linkage further comprises a spring loaded pivot mechanism 70 attached on one end to the pawl 68 and in the middle to the arm 30. FIG. 8 illustrates this mechanism in a longitudinal cross-sectional view with FIG. 11 cutting the arm away laterally depicting the elements clearly. This attachment arrangement allows a pivot point midway in the mechanism with the second half extending from the top of the arm 30. The mechanism 70 has a knob 72 on the end allowing a grasping surface for the operator. Inasmuch as the pawl 68 is free to move in either direction, the mechanism 70 in vertical position closest to the operator engages the top set of teeth into the disk 40, allowing the arm to be lifted under resistance and the spring loaded characteristic of the assembly permits the teeth of the pawl 68 to ride over the engaging surface on the down stroke. When the mechanism 70 is moved forward away from the operator, the reverse function takes place.

The mechanism 70 has a swivel shaft 74 rotatably attached to the pawl 68 and a pivotal sleeve 76 also rotatably connected to the arm 30. The shaft 74 slips into the bottom portion of the sleeve 76 with a compression spring 78 therebetween. An extension rod 80 is permanently joined to the sleeve 76 projecting through the arm 30 and has the knob 72 attached on the top.

In another embodiment, not shown, the pawl 68 is replaced by one of another configuration in that the teeth mesh directly with that of the disk 40 in either directional rotation. This directional linkage then utilizes all of the same elements, except the pawl is bidirectional with a slightly different shape to match the disk 40. In operation the apparatus then has resistance in either direction requiring force to position the arm. The pivot mechanism is also simplified in that the spring 78 is eliminated and the swivel shaft 74 and extension rod 80 may be in one piece. In order to disengage the bidirectional pawl, the lever knob 72 is rotated away from the user and the arm 30 freely moves in either direction, as the teeth are completely disengaged.

Ancillary equipment for this apparatus, that may be removed and replaced to accommodate a different function, include a resilient mat 82, shown in FIG. 1, that is sized to fit into the recessed well 22 that is part of the base 20. This mat 82 is of the same height as the recess 22 making the surface planar with the top of the base 20 and provides a non-slip surface for the operator of the apparatus.

Figure 3:
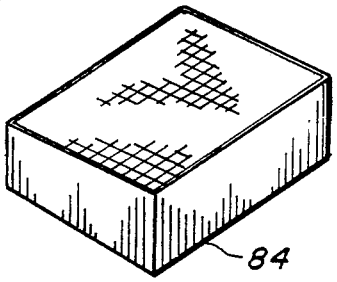
FIG. 3 is a partial isometric view of the tilted platform completely removed from the apparatus.

Another similar device utilizing the same well 22 is a tilted platform 84, best shown in FIG. 3. This platform 84 has a thickness greater than the well 22 in all planes with one end higher than the other making the surface either inclining or declining dependent upon the direction the platform is installed in relation to the biforcated arm 30. With this wedged shaped platform 84, various exercise routines may be performed, such as an inclined forward squat normally utilizing bar bells or abdominal knee bends, and pulling exercises like chinups. The top surface of this platform 84 also contains a non-slip surface similar to the mat 82.

Figure 2:
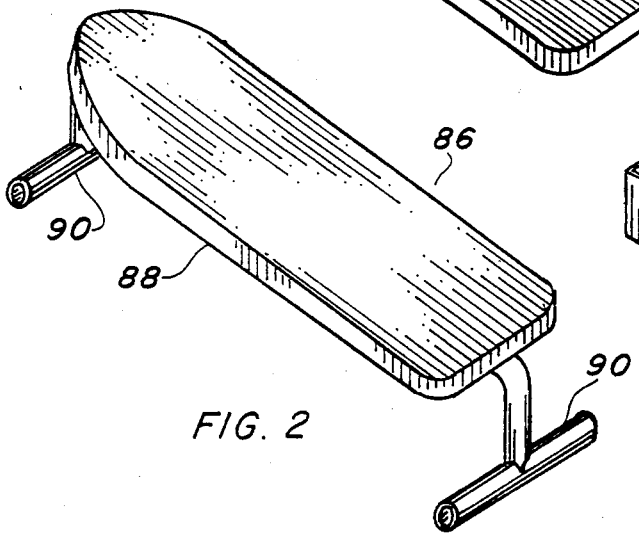
FIG. 2 is a partial isometric view of the users workbench completely removed from the apparatus.

A workbench 86 is also employed in the invention, best illustrated in FIG. 2, removed completely from the device. This bench 86 has a horizontal resilient top 88 that is flat on the upper surface rectangular in shape with forward end rounded. This configuration allows the operator to comfortably straddle the end adjacent to the exercise apparatus. A pair of legs 90 are employed in the front and rear. These legs 90 may be in pairs on both ends, but are preferably a single leg having a radial 90 degree angular bend with a cross-member horizontal support on the bottom, the same width as the recessed well 22, for mounting and containment within. This bench, therefore, provides a raised surface for various exercises accomplished from the sitting position.

A final piece of auxillary equipment that is positioned within the well 22 is a treadmill 92 that has the bottom structure proportionate in size for mounting. This treadmill 92 has a platform configured in wave pattern, creating a heel and toe strike guide, and when installed takes advantage of the forks of the arm 30 to be relied upon as safety handles.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. An exercise apparatus comprising:

(a) a platform base with a flat surface underneath for resting upon a floor and a recessed well disposed within the top surface, rectangular in shape and planar to the underneath portion for receiving ancillary components within;

(b) a pedestal fixed to one end of said base in such a manner as to extend vertically with respect to the base, having a pair of opposed shaft retaining bores therein;

(c) a main shaft rotatably captivated within said shaft retaining bores providing a movable mounting member at right angles to said pedestal;

(d) a biforcated arm movably attached to said main shaft having a pair of angular grips embedded therewithin and a foot pad disposed under each grip for manual manipulation of said arms in an axial direction;

(e) resistance means fixed within said arm drivingly attached to said pedestal in such a manner as to create an adjustable constant tension upon said arm when axially rotated through its arc of movement for exercising the limbs of a person positioned upon said platform base; and, (f) directional linkage means providing said resistance means a fixed direction to which the tension is applied, said directional linkage having means for applying said fixed direction to be reversed. therefore, instantly controlling said arm movement providing both aerobic and isotonic muscle conditioning of the user by movement of the arm against a directional predetermined resistance.

2. The invention as recited in claim 1 wherein said biforcated arm further comprises, a removable center jointed bar with angular ends, each covered with a resilient grip penetrating the ends opposite said main shaft in a horizontal plane for gripping and lifting during exercises.

3. The invention as recited in claim 1 further comprising, a counterweight within said biforcated arm positioned on the end opposite the grips to provide a weight balance for the extended arm allowing the arm to retain its position when linear force is ceased by the operator.

4. The invention as recited in claim 1 wherein said resistance means further comprises:

(a) a geared disk rotationally positioned to freely revolve on said main shaft further contained between the extremes of said pedestal and within the interior of said biforcated arm;

(b) a caliper brake having opposed pads rigidly fixed to said pedestal and slideably abutting the opposite sides of said disk in such a manner as to exert force from the pads in a squeezing manner therebetween creating controllable resistance upon said disk, as it rotates frictionally through the opposed pads;

(c) a hydraulic cylinder disposed within the extremes of said arm providing pressurized fluid to said brake;

(d) hydraulic lines fluidly connecting said cylinder to said brake for transmitting the fluid pressure therebetween;

(e) a pressure gauge in communication with said pressurized fluid to visually indicate the force created by the cylinder, calibrated in such a manner as to manifest the resistance placed upon said biforcated arm designating direct weight required to move said arm; and, (f) a resistance regulating mechanism providing manual adjustment of said hydraulic pressurized fluid so as to govern the resistance of said brake pads upon said geared disk as it moves through said rotational travel, as predetermined by the user.

5. The invention as recited in claim 4 wherein said resistance regulating mechanism further comprises:

(a) a male threaded shaft having a hand wheel rotatably disposed within said biforcated fork for manual presetting the load on said resistance means;

(b) an internally threaded sleeve embracing said threaded shaft converting the rotational movement of said hand wheel to linear motion; and, (c) a pivotal link having a rod rotatably connected to said fork, a first extended lever arm and a second pivotal arm, said first arm slideably fixed to said threaded sleeve transmitting the linear motion through the shaft to the second arm which is rotatably joined to said hydraulic cylinder creating compounded pressure within said hydraulic lines transmitted directly to said caliper brake causing the opposed pads to grip said disk drivingly controlling friction governed by the setting of the gear wheel.

6. The invention as recited in claim 5 further comprising a ratio of 3 to 1 defined by the length of the first lever arm to the second pivotal arm, therefore, creating a mechanical advantage.

7. The invention as recited in claim 1 further comprising, said directional linkage means having a unidirectional pawl rotatably fixed within said fork and a spring loaded pivot mechanism hingingly linked to said pawl, said pawl having teeth inversally meshed to said resistance means on either end allowing only one direction of rotation of the fork, also, said pivot mechanism hinged in such a manner as to allow changing of direction by axially moving an exposed end of said pivot mechanism in one direction or the other, with the spring allowing unrestricted opposite movement.

8. The invention as recited in claim 1 further comprising, a resilient mat slightly smaller than said recessed well in the platform base allowing mounting therewithin, said mat having the same thickness as the well providing a non-slip surface on the platform directly beneath the fork.

9. The invention as recited in claim 1 further comprising, a tilted platform slightly smaller than said recessed well in the platform base allowing mounting therewithin, said mat having a thickness greater than that of the well with one side higher than the other defining an angular platform directly beneath said forks allowing the user a sloped base to stand upon while performing specific exercises on the apparatus.

10. The invention as recited in claim 1 further comprising, a users workbench having a resilient top and a pair of front and rear legs each having horizontal supports for stability, said front support of the same width as said recessed well for mounting and containment within providing a raised flat surface to be used in conjunction with exercise disciplines employing said apparatus.

11. The invention as recited in claim 1 further comprising, a treadmill having a bottom structure proportionate to the well in said platform base for mounting within, said biforcated arms becoming the safety handles when said treadmill is utilized by the operator.

* * * * *